US006022192A

United States Patent [19]

DeLaHoz et al.

[11] Patent Number: 6,022,192

[45] Date of Patent: Feb. 8, 2000

[54] AUTOMATIC CLEANING SYSTEM FOR A CEILING FAN BLADE

[76] Inventors: Herman H. DeLaHoz, 23-37 Cambridge Rd., Fairlawn, N.J. 07410; Martin Hupfl, 68 Probasco Rd., E. Windsor, N.J. 08520

[21] Appl. No.: 09/080,973

[22] Filed: May 19, 1998

[51] Int. Cl.[7] ..... F04D 29/00

[52] U.S. Cl. ..... 416/146 R; 416/5; 416/62; 416/248; 416/501; 15/246

[58] Field of Search ..... 416/5, 62, 146 R, 416/248, 501; 15/246

[56] References Cited

U.S. PATENT DOCUMENTS 5,018,944 5/1991 Bielecki et al. ..... 416/146 R
5,232,347 8/1993 VonBergen ..... 416/244 R

*Primary Examiner*—Edward K. Look
*Assistant Examiner*—Matthew T. Shanley
*Attorney, Agent, or Firm*—Alfred C. Hill

[57] ABSTRACT

An automatic cleaning system for a ceiling fan having a plurality of fan blades extending outwardly from a central motor driven hub comprising a plurality of cleaning units, each in a cleaning engagement with a top surface and a bottom surface of a different one of the plurality of fan blades; and a plurality of recoil units, each connected to the different one of the plurality of fan blades adjacent the central motor driven hub and an associated one of the plurality of cleaning units to enable each of the plurality of cleaning units to travel from a point adjacent the central motor driven hub to an outward end of the different one of the plurality of fan blades due to the centrifugal force when the ceiling fan is running and to retract each of the plurality of cleaning units to the point from the outward end of the different one of the plurality of fan blades when the ceiling fan is not running.

28 Claims, 3 Drawing Sheets

AUTOMATIC CLEANING SYSTEM FOR A CEILING FAN BLADE

BACKGROUND OF THE INVENTION

The present invention relates to ceiling fans and more particularly to an automatic cleaning system for the blades of a ceiling fan.

It is well known that surfaces will collect and accumulate dust and to clean these surfaces it is necessary to wipe this dust off either with a dry dust cloth, or a dust cloth coated with some liquid cleaning material. To clean the dust from the blades of a ceiling fan, it has been necessary in the past to use a step ladder to get up to the height of the blades of the ceiling fan to clean the same with a dry dust cloth, or a dust cloth immersed in some cleaning solution. This can be dangerous, since the cleaning person can fall off the ladder.

A solution to the cleaning of blades of a ceiling fan proposes using a mechanism or device that can be slipped onto the blades with a handle attached thereto so that the person cleaning the fan blades can manipulate this cleaning device from the floor by moving the dusting device back and forth along the blade from the floor. There is also an arrangement similar to this in which a vacuum cleaner has been attached to the cleaning device to vacuum the dust from the blades.

Due to the presently known dangerous and/or cumbersome cleaning arrangements, the dust on the fan blades tend to accumulate to a large extent because the person doing the cleaning does not desire to climb step ladders, or does not have the device to slip over the fan blades for cleaning the same. Therefore, there is a source of dust which could be a disadvantage to those who are allergic to dust and dust mites.

SUMMARY OF THE INVENTION

An object of the present invention is to provide an automatic cleaning system for the fan blades of a ceiling fan.

Another object of the present invention is to provide an automatic cleaning system for the blades of a ceiling fan that does not permit the accumulation of dust on the blades of the fan and, therefore, reduces a source of allergens.

A feature of the present invention is the provision of an automatic cleaning system for a ceiling fan having a plurality of fan blades extending outwardly from a central motor driven hub comprising a plurality of cleaning means, each in a cleaning engagement with a top surface and a bottom surface of a different one of the plurality of fan blades; and a plurality of recoil means, each connected to the different one of the plurality of fan blades adjacent the central motor driven hub and an associated one of the plurality of cleaning means to enable each of the plurality of cleaning means to travel from a point adjacent the central motor driven hub to an outward end of the different one of the plurality of fan blades due to the centrifugal force when the ceiling fan is running and to retract each of the plurality of cleaning means to the point from the outward end of the different ones of the plurality of the fan blades when the ceiling fan is not running.

BRIEF DESCRIPTION OF THE DRAWING

Above-mentioned and other features and objects of the present invention will become more apparent by reference to the following description taken in conjunction with the accompanying drawing, in which.

DESCRIPTION OF THE PREFERRED EMBODIMENTS

Figure 1:
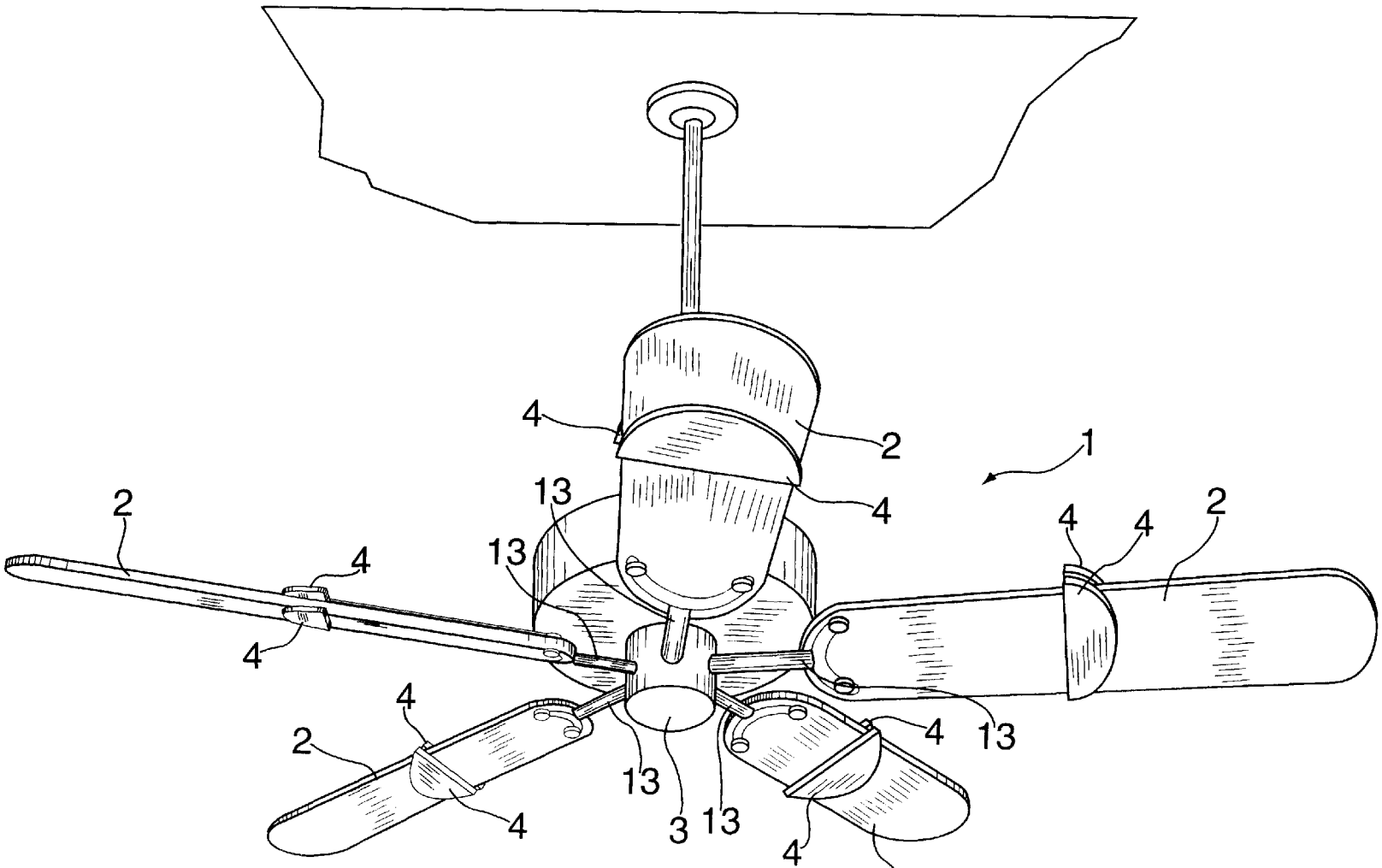
FIG. 1 is a perspective view of a ceiling fan having a plurality of fan blades incorporating thereon the automatic cleaning system in accordance with the principles of the present invention.
Figure 2:
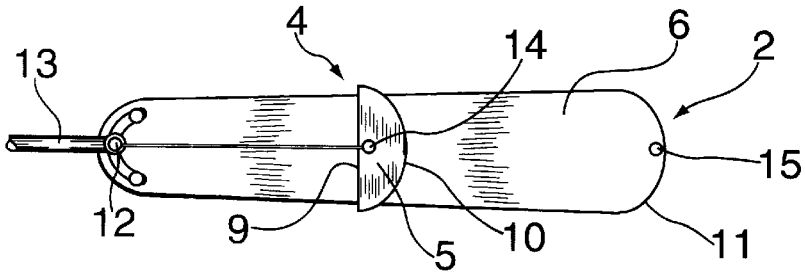
FIG. 2 is a top view of one embodiment of the automatic cleaning system in association with a single one of the plurality of fan blades in accordance with the principles of the present invention.
Figure 3:
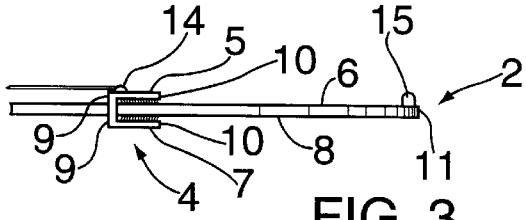
FIG. 3 is a side view of the embodiment of FIG. 2.

Referring to FIG. 1, there is illustrated therein a ceiling fan 1 having a plurality of fan blades 2 extending outwardly from a central motor driven hub 3 incorporating thereon the automatic cleaning system in accordance with the principles of the present invention illustrated to include the units 4, one on each one of the fan blades 2. As shown in greater detail in FIGS. 2 and 3, one embodiment of the cleaning units 4 is shown to include a first cleaning pad 5 to having a predetermined shape in a cleaning engagement with the top surface 6 of the fan blade 2 and a second cleaning pad of the predetermined shape 7 in a cleaning engagement with the bottom surface 8 of the fan blade 2. The cleaning pads 5 and 7 each have a straight edge 9 substantially perpendicular to the fan blade 2 adjacent the central motor driven hub 3 and an edge 10 having a predetermined shape remote from the hub 3 conforming to the shape of the outward end 11 of the fan blade 2. The configuration or shape of edge 10 enables the complete cleaning of the fan blade 2 out to the curved portion thereof. As illustrated in FIGS. 2 and 3, the recoil means is a recoil spring 12 fastened to blade 2 by the central screw or bolt employed to fasten the blade 2 to the rod 13 extending from hub 3. The free end of the recoil spring 12 is attached to the pad 5 in the center thereof adjacent the straight edge 9 by pin 14.

When the ceiling fan 1 is running, the cleaning pad units 4 will be caused to move outwardly along blades 2 due to the centrifugal force and will clean the top and bottom surface of the blades 2 each time that the fan is running to thereby prevent any accumulation of dust on the fan blades 2. When the fan 1 is no longer running, the recoil spring 12 will cause the units 4 to move back to a point adjacent the hub 3. Again causing a cleaning of the fan blades 2.

Each of the fan blades 2 would have a similar arrangement and if there is any problem with the fan balance, weights can be added to the appropriate fan blades to balance out the unbalance of the fan 1 when it is running. Also the units 4 would be very light in weight so as to not cause any binding of the movement due to the centrifugal force and the retraction by the recoil springs 12.

The units 4 in FIGS. 2 and 3, would be a integral unit and would be slipped over the end of the blades 2 to be placed in the proper cleaning arrangement therewith. As a safeguard to prevent the centrifugal force from causing the units 4 to fly off the fan blades 2 a stop 15 is provided at the end of the blades 2 which will prevent the units 4 from flying off the blades 2 under the influence of the centrifugal force. Also the length of the recoil springs 12 can be adjusted so as to prevent the units 4 from flying off the blades 2.

Figure 4:
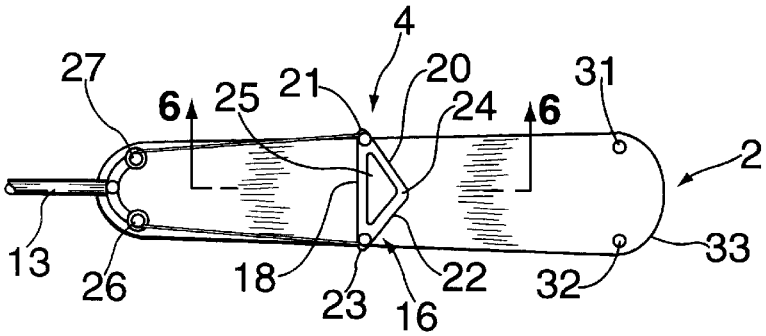
FIG. 4 is a top view of a second embodiment of the automatic cleaning system in association with a single one of the plurality of fan blades of a ceiling fan in accordance with the principles of the present invention.
Figure 5:
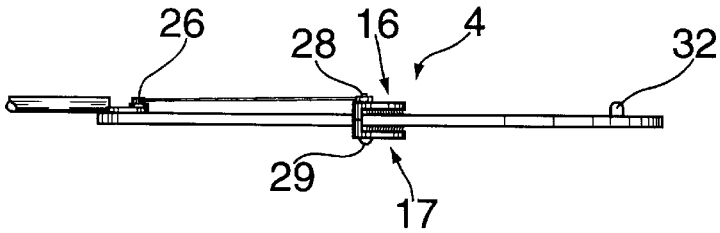
FIG. 5 is a side view of the embodiment of FIG. 4.
Figure 6:
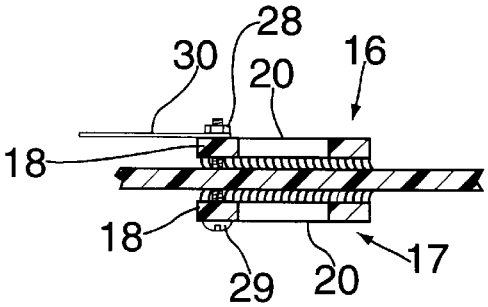
FIG. 6 is an enlarged cross-sectional view taken along line 6—6 of FIG. 4.

Referring the FIGS. 4, 5 and 6, a second embodiment of the units 4 is illustrated. In this embodiment, each of the cleaning pads 16 and 17 include a first member 18 substantially perpendicular to the fan blades 2, a second member 19 connected to one end 20 of member 18 extending inwardly toward a center of the blades 2 at a predetermined angle. A third member 22 is connected to the other end 23 of member 18 extending inwardly toward a center of the blade 2 at the predetermined angle and connected to the end 24 of the second member 20 remote from the first member 18. As illustrated in FIGS. 4, 5 and 6, the pad units 4 are in a triangular configuration with a central opening 25.

In this embodiment of FIGS. 4, 5 and 6, the recoil means includes a pair of recoil springs 26 and 27 each connected adjacent opposite edges of the blades 2 by the two outside screws or bolts used to fasten the blade 2 to the extension 13 of the hub 3. The recoil springs 26 and 27 are fastened to member 18 at the outer edges thereof, such as at 21 and 23, underneath the nut securing the two cleaning pads 16 and 17 together to form a unitary unit.

Again in this embodiment of FIGS. 4, 5 and 6, stops 31 and 32 are provided on the outer edge 33 of the fan blades 2 to prevent the triangular shaped unit from flying off the fan blades 2 under the influence of the centrifugal force. As in the embodiments in FIGS. 2 and 3, the centrifugal force when fan 1 is running causes the units 4 of FIGS. 4, 5 and 6 to move outwardly along the blade to accomplish a first cleaning action and to be retracted by the recoil springs 26 and 27 to provide another cleaning action when the fan is turned off.

Figure 7:
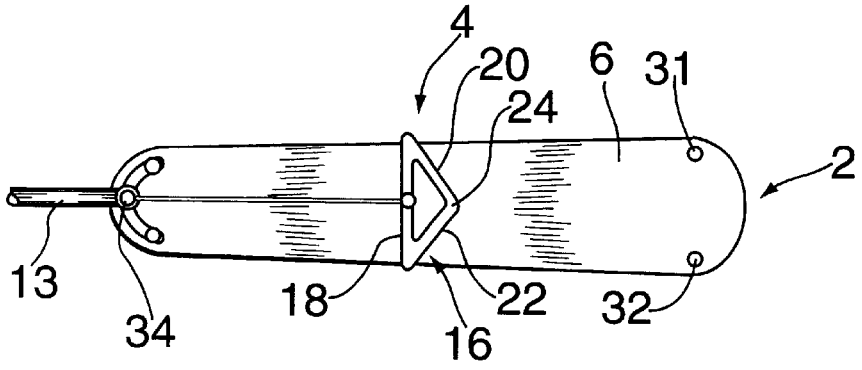
FIG. 7 is a top view of a third embodiment of the automatic cleaning system in association with a single one of the plurality of fan blades of a ceiling fan in accordance with the principles of the present invention.

Referring to FIG. 7, a third embodiment of the automatic cleaning system in accordance with the principles of the present invention is illustrated as including the triangular configuration of the cleaning pads of the embodiment of FIGS. 4, 5 and 6 having the first member 18 perpendicular to the fan blades 2 and the angled members 20 and 22 connected at 24 as described hereinabove with respect to the embodiment of FIGS. 4, 5 and 6. The difference between the embodiment of FIG. 7 and the embodiment of FIGS. 4, 5 and 6 is that only one recoil spring 34 connected to the central part of first member 18 controls the extension and retraction of the units 4.

Figure 8:
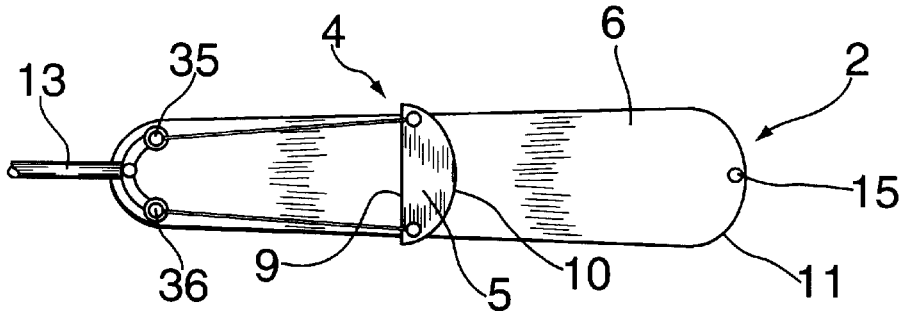
FIG. 8 is a top view of a fourth embodiment of the automatic cleaning system in association with a single one of the plurality of fan blades of a ceiling fan in accordance with the principles of the present invention.

Referring to FIG. 8, a fourth embodiment of the automatic cleaning system in accordance with the principles of the present invention is illustrated which includes the cleaning pad similar to that shown in FIGS. 2 and 3 and described as including a straight edge 9 substantially perpendicular to the fan blades 2 and a curved outer edge 10 having a predetermined configuration to conform to the configuration of the outer edge 11 of the fan blades 2. The difference between the embodiments of FIG. 8 and FIGS. 2 and 3 is that a pair of recoil springs 35 and 36 are employed and connected adjacent the outer edges of the cleaning pads 5 so as to control the outward movement of the cleaning units 4 when the motor is running and the retraction of cleaning units 4 when the fan 1 stops after being run.

Figure 9:
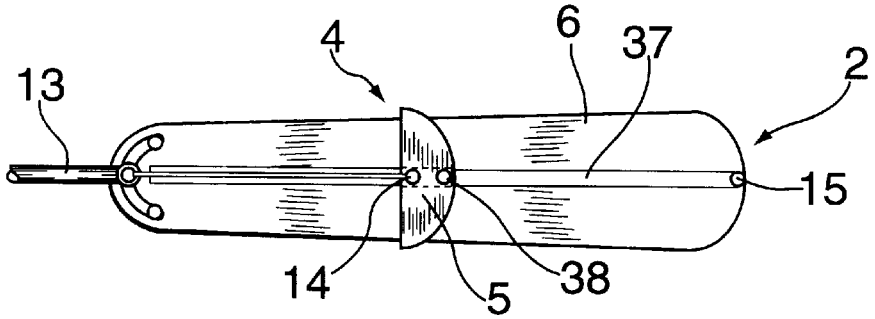
FIG. 9 is a top view of a fifth embodiment of the automatic cleaning system in association with a single one of the plurality of fan blades of a ceiling fan in accordance with the principles of the present invention.
Figure 10:
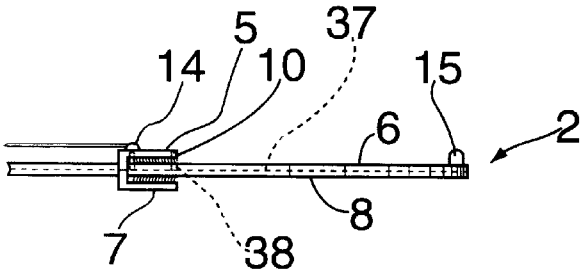
FIG. 10 is a side view of the embodiment of FIG. 9.

Referring to FIGS. 9 and 10, a fifth embodiment of the automatic cleaning system in accordance with the principles of the present invention is illustrated which includes the cleaning pad 5 similar to that shown in FIGS. 2 and 3. The difference being that the embodiment of FIG. 9 includes a track or groove 37 disposed in the center of blade 2 engaged by pin 38 and an extension of pin 14. This arrangement prevents unit 4 from binding on the blade 2 in its travels along blade 2.

Figure 11:
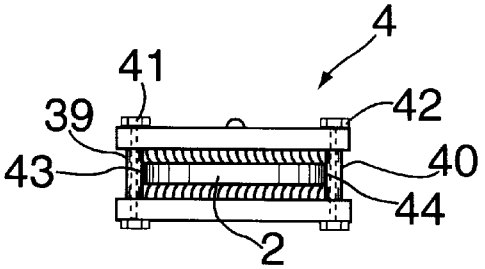
FIG. 11 is an end view of still another embodiment of the automatic cleaning system in association with a single one of the plurality of fan blades of a ceiling fan that can be employed with any of the previous embodiments in accordance with the principles of the present invention.

Referring to FIG. 11, still another embodiment of the automatic cleaning system in accordance with the principles of the present invention is illustrated which includes units 4 similar to that illustrated in FIGS. 2, 4, 7 and 8. The difference being that the embodiment of FIG. 11 includes roller bearings 39 and 40 disposed between the cleaning pads of unit 4 rotatable on pins 41 and 42 to provide the units 4. Roller bearings 39 and 40 engage the edges of 43 and 44 of blades 2 thereby preventing binding of unit 4 on blades 2 in its movement along blades 2.

While we have described above the principles of our invention in connection with specific apparatus, it is to be clearly understood that this description is made only by way of example and not as a limitation to the scope of our invention as set forth in the objects thereof and in the accompanying claims.

We claim:

1. An automatic cleaning system for a ceiling fan having a plurality of fan blades extending outwardly from a central motor driven hub comprising:

a plurality of cleaning means, each in cleaning engagement with a top surface and a bottom surface of a different one of said plurality of fan blades; and a plurality of recoil means, each connected to said different one of said plurality of fan blades adjacent to said central motor driven hub and an associated one of said plurality of cleaning means to enable each of said plurality of cleaning means to travel from a point adjacent said central motor driven hub to an outward end of said different one of said plurality of fan blades due to centrifugal force when said ceiling fan is running and to retract said each of said plurality of cleaning means to said point from said outward end of said different one of said plurality of fan blades when said ceiling fan is not running.

2. An automatic cleaning system according to claim 1, wherein each of said plurality of cleaning means includes an integral unit having a first cleaning pad of predetermined shape in said cleaning engagement with said top surface, and a second cleaning pad of said predetermined shape in said cleaning engagement with said bottom surface.

3. An automatic cleaning system according to claim 2, wherein each of said first cleaning pad and said second cleaning pad have a straight edge substantially perpendicular to said different one of said plurality of fan blades adjacent said point and an edge having a predetermined shape remote from said point conforming to the shape of said outward end of said different one of said plurality of fan blades to enable complete cleaning of said different one of said plurality of fan blades.

4. An automatic cleaning system according to claim 3, wherein each of said plurality of recoil means includes a single recoil spring secured to a center of said top surface of said different one of said plurality of fan blades adjacent said central motor driven hub and connected in a center of said first cleaning pad adjacent said straight edge.

5. An automatic cleaning system according to claim 3, further including a groove disposed centrally of and extending the length of one of said top surface and said bottom surface of each of said different one of said plurality of fan blades, and a pair of pins extending from an associated one of said first cleaning pad and said second cleaning pads spaced along a central line thereof to engage said groove thereby preventing binding of said first and second cleaning pads in its movement along an associated one of said different one of said plurality of fan blades.

6. An automatic cleaning system according to claim 3, further including a pair of spaced roller bearings disposed between each of said first cleaning pad and said second cleaning pad and each engaging opposite edges of an associated one of said different one of said plurality of fan blades.

7. An automatic cleaning system according to claim 3, wherein each of said plurality of recoil means includes a pair of recoil springs secured to said top surface of said different one of said plurality of fan blades, each of said pair of recoil springs being secured to said top surface adjacent opposite edges of said different one of said plurality of fan blades adjacent said central motor driven hub and connected to opposite edges of said first cleaning pad adjacent said straight edge.

8. An automatic cleaning system according to claim 2, wherein each of said first cleaning pad and said second cleaning pad includes a first member substantially perpendicular to said different one of said plurality of fan blades, a second member connected to one end of said first member and extending inwardly toward a center of said different one of said plurality of fan blades at a predetermined angle, and a third member connected to the other end of said first member, extending inwardly toward a center of said different one of said plurality of fan blades at said predetermined angle and connected to an end of said second member remote from said first member.

9. An automatic cleaning system according to claim 8, further including a groove disposed centrally of and extending the length of one of said top surface and said bottom surface of each of said different one of said plurality of fan blades, and a pair of pins extending from an associated one of said first cleaning pad and said second cleaning pads spaced along a central line thereof to engage said groove thereby preventing binding of said first and second cleaning pads in its movement along an associated one of said different one of said plurality of fan blades.

10. An automatic cleaning system according to claim 8, further including a pair of spaced roller bearings disposed between each of said first cleaning pad and said second cleaning pad and each engaging opposite edges of an associated one of said different one of said plurality of fan blades.

11. An automatic cleaning system according to claim 8, wherein each of said plurality of recoil means includes a single recoil spring secured to a center of said top surface of said different one of said plurality of fan blades adjacent said central motor driven hub and connected in a center of said first member of said first cleaning pad.

12. An automatic cleaning system according to claim 8, wherein each of said plurality of recoil means includes a pair of recoil springs secured to said top surface of said different one of said plurality of fan blades, each of said pair of recoil springs being secured to said top surface adjacent opposite edges of said different one of said plurality of fan blades adjacent said central motor driven hub and connected to opposite ends of said first member of said first cleaning pad.

13. An automatic cleaning system according to claim 1, wherein each of said plurality of cleaning means includes a first cleaning pad of predetermined shape in said cleaning engagement with said top surface, a second cleaning pad of said predetermined shape in said cleaning engagement with said bottom surface, and fastening means engaging said first cleaning pad and said second cleaning pad on opposite sides of said different one of said plurality of fan blades to provide an integral cleaning unit.

14. An automatic cleaning system according to claim 13, wherein said fastening means includes a pair of spaced roller bearings disposed between each of said first cleaning pad and said second cleaning pad and each engaging opposite edges of an associated one of said different one of said plurality of fan blades.

15. An automatic cleaning system according to claim 1, wherein each of said plurality of cleaning means has a given light weight to prevent binding on said different one of said plurality of fan blades as each of said plurality of cleaning means moves along said different one of said plurality of fan blades.

16. An automatic cleaning system according to claim 1, further including stop means secured to said outward end of each of said plurality of fan blades to prevent said plurality of cleaning means from flying off its associated one of said plurality of fan blades under influences of said centrifugal force.

17. An automatic cleaning system according to claim 16, wherein each of said plurality of cleaning means includes an integral unit having a first cleaning pad of perpendicular shape in said cleaning engagement with said top surface, and a second cleaning pad of said predetermined shape in said cleaning engagement with said bottom surface.

18. An automatic cleaning system according to claim 17, wherein each of said first cleaning pad and said second cleaning pad have a straight edge substantially perpendicular to said different one of said plurality of fan blades adjacent said point and an edge having a predetermined shape remote from said point conforming to the shape of said outward end of said different one of said plurality of fan blades to enable complete cleaning of said different one of said plurality of fan blades.

19. An automatic cleaning system according to claim 18, further including a groove disposed centrally of and extending the length of one of said top surface and said bottom surface of each of said different one of said plurality of fan blades, and a pair of pins extending from an associated one of said first cleaning pad and said second cleaning pads spaced along a central line thereof to engage said groove thereby preventing binding of said first and second cleaning pads in its movement along an associated one of said different one of said plurality of fan blades.

20. An automatic cleaning system according to claim 18, further including a pair of spaced roller bearings disposed between each of said first cleaning pad and said second cleaning pad and each engaging opposite edges of an associated one of said different one of said plurality of fan blades.

21. An automatic cleaning system according to claim 18, wherein each of said plurality of recoil means includes a single recoil spring secured to a center of said top surface of said different one of said plurality of fan blades adjacent said central motor driven hub and connected in a center of said first cleaning pad adjacent said straight edge.

22. An automatic cleaning system according to claim 18, wherein each of said plurality of recoil means includes a pair of recoil springs secured to said top surface of said different one of said plurality of fan blades, each of said pair of recoil springs being secured to said top surface adjacent opposite edges of said different one of said plurality of fan blades adjacent said central motor driven hub and connected to opposite edges of said first cleaning pad adjacent said straight edge.

23. An automatic cleaning system according to claim 17, wherein each of said first cleaning pad and said second cleaning pad includes a first member substantially perpendicular to said different one of said plurality of fan blades, a second member connected to one end of said first member and extending inwardly toward a center of said different one of said plurality of fan blades at a predetermined angle, and a third member connected to the other end of said first member, extending inwardly toward a center of said different one of said plurality of fan blades at said predetermined angle and connected to an end of said second member remote from said first member.

24. An automatic cleaning system according to claim 23, wherein each of said plurality of recoil means includes a single recoil spring secured to a center of said top surface of said different one of said plurality of fan blades adjacent said central motor driven hub and connected in a center of said first member of said first cleaning pad.

25. An automatic cleaning system according to claim 23, wherein each of said plurality of recoil means includes a pair of recoil springs secured to said top surface of said different one of said plurality of fan blades, each of said pair of recoil springs being secured to said top surface adjacent opposite edges of said different one of said plurality of fan blades adjacent said central motor driven hub and connected to opposite ends of said first member of said first cleaning pad.

26. An automatic cleaning system according to claim 16, wherein each of said plurality of cleaning means includes a first cleaning pad of predetermined shape in said cleaning engagement with said top surface, a second cleaning pad of said predetermined shape in said cleaning engagement with said bottom surface, and fastening means engaging said first cleaning pad and said second cleaning pad on opposite sides of said different one of said plurality of fan blades to provide an integral cleaning unit.

27. An automatic cleaning system according to claim 26, wherein a pair of spaced roller bearings disposed between each of said first cleaning pad and said second cleaning pad and each engaging opposite edges of an associated one of said different one of said plurality of fan blades.

28. An automatic cleaning system according to claim 16, wherein each if said plurality of cleaning means has a given light weight to prevent binding on said different one of said plurality of fan blades as each of said plurality of cleaning means moves along said different one of said plurality of fan blades.

* * * * *